US005354423A

United States Patent [19]

van Heiningen et al.

[11] Patent Number: 5,354,423

[45] Date of Patent: Oct. 11, 1994

[54] OZONE DIOXANE BLEACHING OF CHEMICAL PULPS

[75] Inventors: Adriaan R. P. van Heiningen, Mouth of Keswick; Yonghao Ni, Fredericton, both of Canada

[73] Assignee: University of New Brunswick, Fredericton, Canada

[21] Appl. No.: 24,058

[22] Filed: Mar. 1, 1993

[51] Int. Cl.[5] ..... D21C 9/10; D21C 9/153

[52] U.S. Cl. ..... 162/65; 162/72

[58] Field of Search ..... 162/72, 65

[56] References Cited

FOREIGN PATENT DOCUMENTS 53-49107 5/1978 Japan .
53-7890403 8/1978 Japan .

OTHER PUBLICATIONS

"The Effect of Cellulose Protectors on Ozone Bleaching of Kraft Pulp" by Kamisima published in the Journal of Japanese Technical Association of the Pulp & Paper Industry, vol. 31, 9, pp. 62–70, Sep. 1977.

"The Use of Ozone in Bleaching of Pulps" by Liebergott et al., 1991 Pulping Conference, TAPPI Proceedings, pp. 1–23.

"Ozone Bleaching of Kraft Pulps" by Rothenberg et al., Oct. 1971, Empire State Paper Research Institute, Report No. 54.

*Primary Examiner*—Steve Alvo
*Attorney, Agent, or Firm*—C. A. Rowley

[57] ABSTRACT

A method of bleaching a chemical pulp with a gaseous bleaching agent by uniformly impregnating the pulp with a solvent for lignin and that is fully miscible with water but does not significantly swell cellulose so that the availability, of lignin to the bleaching agent is significantly improved, then subjecting the impregnated pulp to the action of the bleaching agent to preferentially attack the lignin for its subsequent solubilization and separation from the pulp.

5 Claims, 3 Drawing Sheets

OZONE DIOXANE BLEACHING OF CHEMICAL PULPS

FIELD OF THE INVENTION

Present invention relates to a method of bleaching pulp. More particularly the present invention relates to a method of ozone bleaching of chemical pulps pretreated to improve the selectivity of the bleaching agent to react with the lignin in the pulp.

BACKGROUND OF THE PRESENT INVENTION

It is conventional practice to bleach chemical pulps using bleaching agents such as chlorine and chlorine dioxide to produce pulps having the desired degree of whiteness. The use of chlorine has been described as detrimental to the environment particularly when contained in the effluent from the pulp mill, and thus efforts have been made to either eliminate chlorine and/or chlorine compounds or to reduce their use to an absolute minimum.

Peroxides such as hydrogen peroxide have been used in different stages of bleaching to obtain the desired brightness of pulp and reduce the amount of chlorine applied.

Ozone is also used as a bleaching agent to obtain the required brightness of chemical pulps. However, ozone has been known to degrade chemical pulps and thereby reduce their quality, in particular the strength characteristics of the chemical pulp. It is generally accepted in the industry that the viscosity of the pulp provides a very good indication of the strength potential of the pulp, i.e. the higher the viscosity the better the strength characteristics at a given kappa or permanganate no.

It has also been suggested to replace the water, which is the medium in which the pulp is normally contained, with a suitable organic solvent such as ethanol and methanol, and to bleach the pulp using ozone gas as described for example in Japanese patent 7849107 published May 4, 1978 by Ueshima. This patent describes a process for recovering methanol from the digestion of wood chips with sodium hydroxide and $Na_2S$ and using this recovered methanol as a protector for the wood pulp during the ozone bleaching. In this patent air dried pulp was impregnated with methanol substantially free of water and was not acidified.

Japanese patent 7890403 published Aug. 9, 1978 to Ueshima et al. describes another application of methanol followed by ozone bleaching of the methanol containing pulp. Again, in this patent, the water free pulp was impregnated with methanol which was free of water and was not acidified. The impregnated pulp was subsequently ozonated. This patent did not show as good results as those obtained in the earlier patent described above.

An article entitled "The effect of cellulose protectors on ozone bleaching of kraft pulp" by Kamisima published in the Journal of Japanese Technical Association of the Pulp and Paper Industry, Vol. 31, 9, pp 62–70, September 1977, describes a number of different solvents that may be used to protect the pulp during an ozone bleaching stage. In these teachings, air dried pulp is treated with the organic solvents (alcohols), substantially free of water, and without addition of any acid, and then bleached with ozone. This publication indicates that ethanol is not effective in improving the viscosity of the ozone bleached pulp whereas the use of methanol does produce a positive result.

An article entitled "The use of ozone in bleaching of pulps" by Liebergott et al. 1991 Pulping Conference, TAPPI Proceedings, pp 1–23, provides a review of the literature on ozone bleaching and describes a number of different chemicals that have been tried, i.e. added to the pulp before and in combination with an ozone bleaching stage in attempts to overcome or significantly reduce the detrimental effects of the ozone stage on the quality of the bleached pulp. This article does not list dioxane as having been tried.

In Empire State Paper Research Institute report no. 54 titled "Ozone Bleaching of Kraft Pulps" by Rothenberg et al. October 1971 the use of various percentages of dioxane in water, combined with 1% acetic acid as a medium for ozone bleaching are reported. However the results obtained were not encouraging, and the ozone (lignin-carbohydrate) selectivity decreased when the concentration of dioxane increased above 35%.

BRIEF DESCRIPTION OF THE PRESENT INVENTION

It is an object of the present invention to provide an improved process for bleaching pulps using a gaseous bleaching agent such a ozone.

Broadly, the present invention relates to an ozone bleached chemical pulp having a viscosity equivalent to a viscosity of about 21 mPa.s at a kappa no. of 5 for Northern softwood kraft pulp.

Broadly the present invention relates to a method of bleaching a chemical pulp with a gaseous bleaching agent comprising uniformly impregnating said pulp with an aqueous medium that is a solvent for lignin, is fully miscible with water, but does not significantly swell cellulose in said pulp, said medium being present in an amount sufficient to significantly improve the availability of lignin to said bleaching agent, then uniformly subjecting said impregnated pulp to the action of said gaseous bleaching agent to preferentially attack and degrade said lignin to facilitate its subsequent removal.

Preferably said bleaching agent will comprise ozone.

Preferably said solvent will comprise dioxane.

Preferably said dioxane will be present in an amount of at least 25% dioxane in water and preferably between 50 and 90% dioxane in water.

BRIEF DESCRIPTION OF THE DRAWINGS

Further features, objects and advantages will be evident from the following detailed description of the preferred embodiments of the present invention taken in conjunction with the accompanying drawings in which.

DETAILED DESCRIPTION OF THE INVENTION

Figure 1:
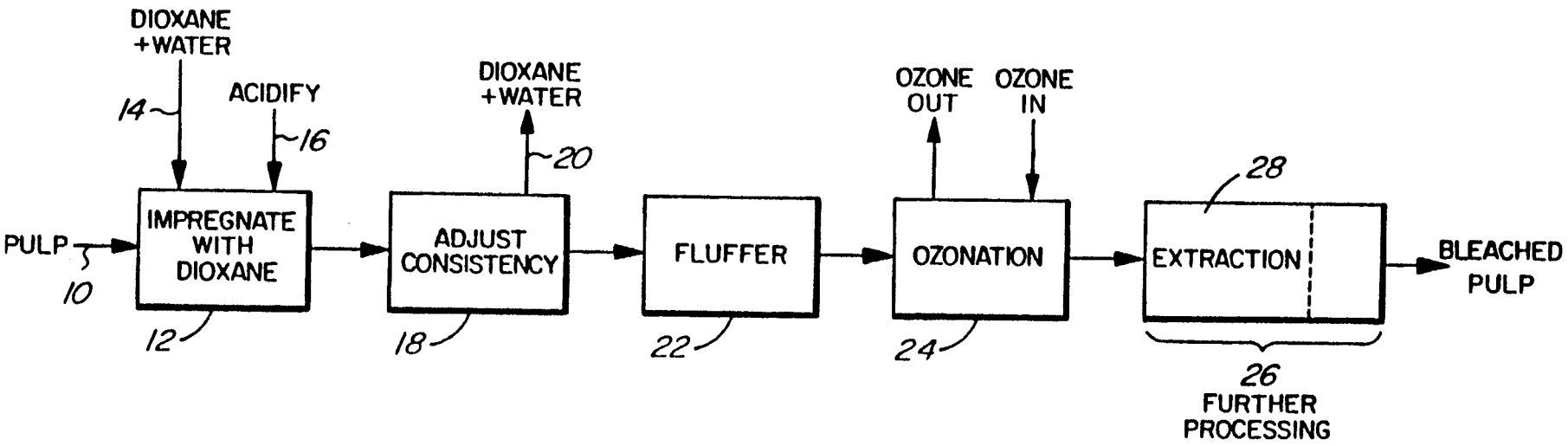
FIG. 1 is a schematic illustration of the process of the present invention.

A chemical pulp is introduced as indicated at 10 and impregnated in the impregnation zone 12 with a medium that is a solvent for lignin but does not significantly swell the cellulose of the pulp. This medium thus tends to expand the lignin to a much more significant extent than the cellulose which preferably will not expand and more preferably may shrink and thereby make the lignin more accessible for reaction with the gaseous bleaching agent.

A solution of dioxane in water, more specifically a solution of 1,4-dioxane and water has been found to function as a satisfactory medium to obtain the desired results.

The medium must contain at least 25% dioxane (% by weight) in water and preferably 50 to 90% dioxane by weight in water.

The medium is introduced to the impregnation zone 12 as schematically indicated at 14. The pH of the pulp is also adjusted to that desired for use in the ozonation stage 24 (to be described below) normally to a pH of about 1.5 to 5, preferably 2 to 3 by the addition of a suitable mineral acid as indicated at 16. It is believed that the use of a mineral acid such as sulphuric acid as opposed to acetic acid contributes to the advantage obtained by the present invention.

The consistency of the wet pulp mass is adjusted as indicated at 18 by any suitable means, for example by pressing, to that required during the ozonation stage 24 which preferably will be at a high consistency of between about 20 and 60% and more preferably to about 40%. The excess impregnation liquor is removed as indicated at 20.

The pulp is then fluffed in the fluffer 22 at room temperature to obtain the desired particle open structure of the pulp mass which is required to obtain uniform contact of the ozone with the impregnated pulp in the ozonation stage 24. The fluffed pulp is then transferred to the ozonation stage 24 which may take place in any suitable a vessel, provided the pulp is uniformly contacted with the ozone containing gas stream. Uniform application of ozone to the pulp is very important to obtaining the required results.

The total ozone charge, expressed as percentage on oven dried pulp, will be selected based on the desired lignin content or the final brightness required and the other or further processing steps (as indicated at 26) to be applied.

The further processing steps as represented at 26 may include an extraction stage as indicated at 28.

The ozonation stage 24 may consist of a plurality of individual applications of ozone with or without intermediate treatments to replace the impregnation liquor and subsequent refluffing of the pulp.

The amount of ozone applied in the ozonation stage will generally be in the range of 0.5 to 3.0% based on the dry weight of the pulp. Generally the conditions used in the ozonation stage of the present invention normally will be essentially the same as the conditions applied in conventional ozonation bleaching of chemical pulp although if desired, lower temperatures may be used.

After ozone treatment in the ozonation stage 24 the pulp may be further treated as indicated at 26 using any suitable treatment such as alkaline extraction, further bleaching stages using other suitable bleaching agents if desired, washed, etc.

The following examples will help to clarify the present invention and illustrate its operation and effectiveness.

EXPERIMENTAL PROCEDURE

Examples

The ozone bleaching experiments forming the examples were performed in a standard rotovap equipment modified with a fritted glass gas dispersion tube inserted in the rotating round bottom flask. About 10 grams of fluffed unbleached chemical pulp at approximately 40% consistency was contacted in the flask with a 3.83% (by weight) ozone in air mixture introduced through the gas dispersion tube at a flow rate of 1.04 l/min. The unreacted ozone leaving the flask is captured in a wash bottle filled with a KI solution and measured by iodometric titration. The ozone charge can be varied by changing the time that the ozone-air mixture flows through the pulp. The rotational speed of the flask was kept at a low level of 4–5 rpm. The ozonation of pulp was performed at room temperature.

Example 1

Kraft Hemlock pulp (kappa no. 31.9, viscosity 35.8 mPa.s according to TAPPI standard 230 om-82) was treated with ozone in the rotovap equipment described above. In one case the pulp was impregnated with acidified ($H_2SO_4$) water, in the other case an acidified ($H_2SO_4$) mixture of 1,4 dioxane and water (70.5 weight % dioxane) was used. The pH of both solutions was 1.8. The pulps were contacted with different single charges of ozone. After the ozone treatment the pulps were thoroughly washed with tap water. The kappa no. and viscosity of the washed pulps were determined and the results are listed in Table 1. The results for the water- and dioxane-water impregnated pulps are also displayed in FIGS. 2 and 3 as respectively the kappa number versus ozone consumption and the viscosity versus kappa number.

Figure 2:
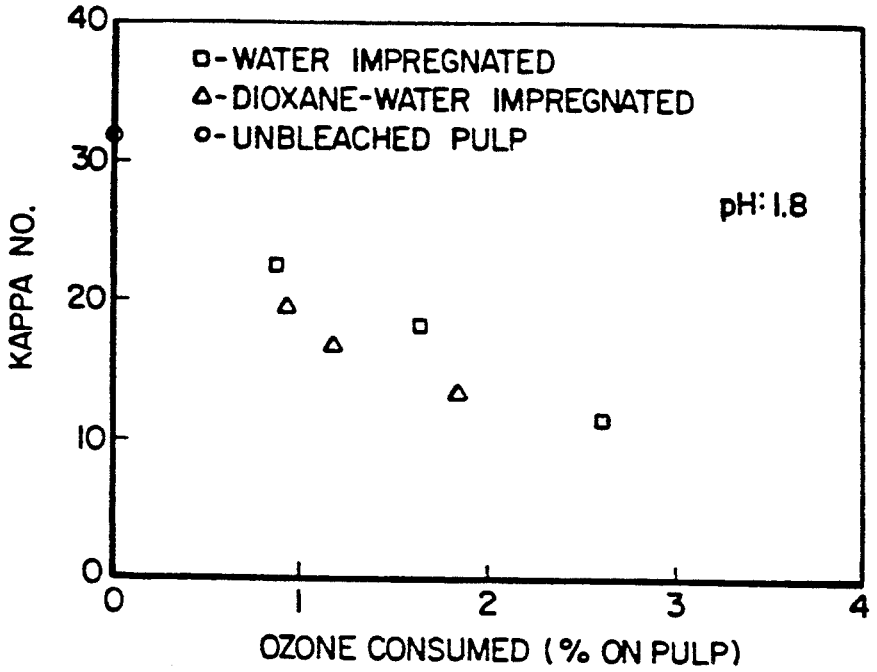
FIGS. 2 and 4 each are a plot of kappa no. versus ozone consumed indicating the result of the presence of dioxane in the medium (impregnation solution) on the (lignin) ozone reaction efficiency.
Figure 3:
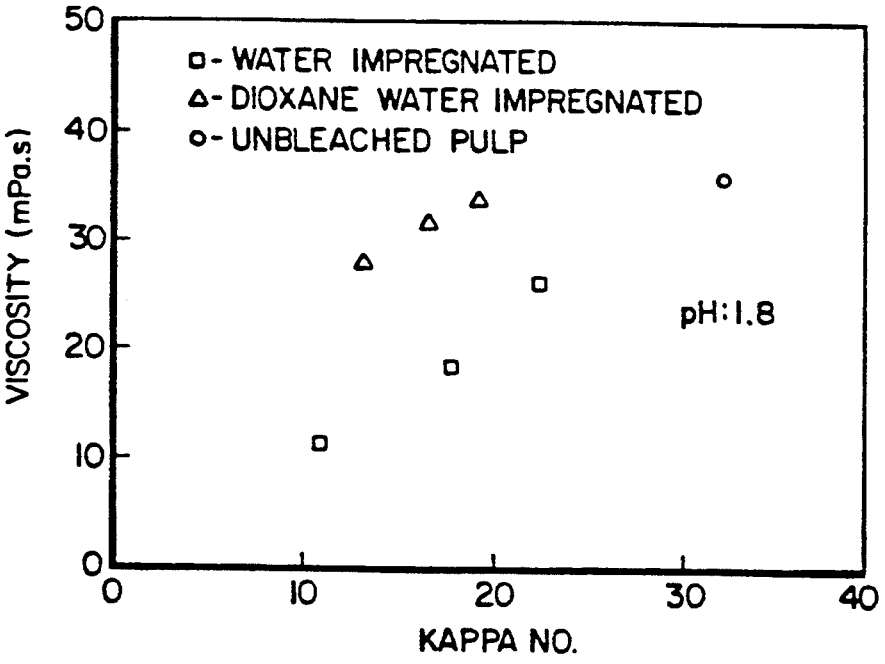
FIGS. 3 and 5 each are a plot of viscosity versus kappa no. showing the influence of the presences of dioxane in the medium (impregnation solution) on the (lignin-carbohydrate) ozone selectivity.

FIG. 2 shows that the delignification of the dioxane-water impregnated pulps is somewhat higher at the same ozone consumption than the water impregnated pulps. More important, however, is the substantially lower viscosity loss at the same kappa shown in FIG. 3 for the dioxane-water impregnated pulps after ozonation as compared to the water impregnated pulps. In other words, this example shows that the presence of dioxane in the pulp during ozone bleaching leads to improvements in the (lignin) ozone reaction efficiency and (lignin-carbohydrate) ozone selectivity.

TABLE 1

| Dioxane-Water as Impregnation Liquid | | | | Water as Impregnation Liquid | | | |
|---|---|---|---|---|---|---|---|
| $O_3$ (% on o.d. pulp) | | Kappa | Viscosity | $O_3$ (% on o.d. pulp) | | Kappa | Viscosity |
| Suppl | Consum | No. | (mPa.s) | Suppl | Consum | No. | (mPa.s) |
| 1.08 | 0.93 | 19.2 | 32.1 | 1.08 | 0.87 | 22.3 | 25.9 |
| 1.40 | 1.18 | 16.5 | 31.5 | 2.16 | 1.64 | 17.8 | 18.3 |
| 2.16 | 1.85 | 13.0 | 27.9 | 4.36 | 2.60 | 11.0 | 11.2 |

Example 2

The variable in this example was the composition of the dioxane-water solution used for impregnation of the kraft Hemlock pulp (kappa no. of 31.9, viscosity 35.8 mPa.s) before ozonation. Seven solutions with a weight percentage of dioxane of respectively 0, 4.8%, 9.8%, 25.4%, 48.2%, 70.6% and 100% were used. The dioxane-water solutions were not acidified and the measured pH varies from 3.7 to 4.0. The pH of the pure water impregnation liquid is around 7.0. After impregnation, the pulp was squeezed to remove excess of the impregnation liquid, fluffed, transferred at a consistency of about 32% to the flask of the rotovap equipment, and treated with a single charge of ozone. For the other experimental conditions see the Experimental Procedure.

After ozonation the pulp was washed with large amounts of tap water, made into a handsheet and air-dried. The kappa number and viscosity of the air-dried sheets of the different experiments are summarized in Table 2 which shows that as the weight percentage of dioxane in the dioxane-water impregnation solution increases, the viscosity of the ozonated pulp increases until a plateau is reached at 70.6% dioxane in water. The delignification appears to be most efficient at a dioxane weight percentage of 48.2%. Since 100% dioxane is not favourable in terms of delignification it can be concluded that the presence of water is essential to maximize the delignification. Comparison of the results obtained with 0% and 70.6% dioxane in water shows that in the former case the viscosity drops from 35.8 mPa.s to 22.4 mPa.s, while in the latter a viscosity of 32.2 mPa.s is obtained at a slightly larger ozone consumption (resp. 1.6 versus 1.73%).

TABLE 2

| Dioxane in Water (weight %) | $O_3$ Supplied (% on o.d. pulp) | $O_3$ Consumed (% on o.d. pulp) | Kappa No. | Viscosity (mPa.s) |
|---|---|---|---|---|
| 0 | 1.96 | 1.60 | 21.8 | 22.4 |
| 4.8 | 2.16 | 1.59 | 22.0 | 24.4 |
| 9.8 | 2.16 | 1.70 | 20.0 | 24.1 |
| 25.4 | 2.16 | 1.68 | 19.1 | 27.3 |
| 48.2 | 2.16 | 1.71 | 18.4 | 29.9 |
| 70.6 | 2.16 | 1.73 | 19.4 | 32.2 |
| 100 | 2.96 | 2.41 | 21.5 | 32.2 |

Example 3

Comparison of the results in Example 1 and 2 obtained with 70.6% dioxane in the dioxane-water impregnation liquid indicates that the (lignin) ozone efficiency is much improved at the lower pH, while the pH has only a minor effect on the (lignin-cellulose) ozone selectivity. This Example investigates the combined effect of the pH and dioxane concentration of the impregnation solution on the ozone bleaching response of the kraft Hemlock pulp (kappa 31.9, viscosity 35.8 mPa). In two series of tests the pH of the impregnation solution was adjusted to respectively 1.8 and 2.3 by addition of 4N sulfuric acid. In these two series of tests a single ozone charge of 1.08% was applied and the pulp consistency was about 40%.

The results thus obtained are listed in Table 3. It is again apparent from Table 3 that the viscosity of the ozonated pulp increases with increasing dioxane weight percentage of the impregnation solution. Comparison of the results obtained at the two pH levels shows that the higher viscosities are obtained at a pH of 2.3, while the kappa number of corresponding pulps at the two pH levels are approximately the same.

Comparison of the results in Tables 2 and 3 shows that the amount of ozone charged in the case without acidification is about double that in the two cases with sulfuric acid addition, while the delignification achieved is similar in all three cases. Therefore, these experiments show that the addition of a small amount of a mineral acid is very beneficial to achieve a high (lignin) ozone reaction efficiency while a large improvement in the (lignin-cellulose) ozone selectivity is obtained when a dioxane weight percentage of about 70–75% is used for the dioxane-water impregnation solution.

TABLE 3

| pH 1.8 | | | | | pH 2.3 | | | | |
|---|---|---|---|---|---|---|---|---|---|
| Dioxane (wgt %) | Kappa No. | Viscosity (mPa.s) | $O_3$ (% on pulp) Suppl | $O_3$ (% on pulp) Consum | Dioxane (wgt %) | Kappa No. | Viscosity (mPa.s) | $O_3$ % (% on pulp) Suppl | $O_3$ % (% on pulp) Consum |
| 0 | 22.3 | 25.9 | 1.08 | 0.87 | 0 | 20.6 | 23.9 | 1.08 | 0.86 |
| 10 | 20.2 | 24.7 | 1.08 | 0.88 | 10 | 20.8 | 26.7 | 1.08 | 0.87 |
| 25 | 20.3 | 27.1 | 1.08 | 0.86 | 25 | 20.2 | 28.0 | 1.08 | 0.86 |
| 50 | 20.4 | 29.8 | 1.08 | 0.88 | 50 | 19.4 | 31.7 | 1.08 | 0.86 |
| 70.6 | 19.3 | 31.8 | 1.08 | 0.93 | 75 | 20.5 | 33.4 | 1.08 | 0.90 |

Example 4

The pulp was ozonated after impregnation with an acidified (pH of 1.8) dioxane-water solution containing 70.6 weight percent dioxane. Excess solution was subsequently removed by squeezing the impregnated pulp and after fluffing the pulp was treated in the rotovap equipment at a consistency of about 40%. In all experiments the same unbleached Hemlock kraft pulp as in the previous example was used. In the first experiment the unbleached pulp was treated with 2.16% $O_3$ on o.d. pulp (actual ozone consumption was 1.85%). The $O_3$ treated pulp was washed with water and air dried. Its kappa number and viscosity are respectively 13.0 and 27.9 mPa.s. The ozone treated and washed pulp was subsequently reimpregnated with dioxane-water, fluffed and subjected to another ozone charge of 2.59% on pulp (actual consumption was 1.67%). The pulp consistency during ozonation was again about 40%. After a water wash and air drying it was found that the pulp had a kappa number of 5.0 and a viscosity of 16.2 mPa.s.

In another series of tests, the unbleached Hemlock kraft pulp was treated with 1.08% $O_3$ on o.d. pulp (actual consumption 0.93%). The kappa no. and viscosity of the water washed pulp after this first ozonation stage were 19.2 and 32.1 mPa.s respectively. After reimpregnation, consistency adjustment and fluffing, the pulp was treated with another ozone charge of 1.08% on o.d. pulp (1.0% $O_3$ was actually consumed). The kappa no.

and viscosity of the water washed pulp after the two ozone stages are 9.6 and 25.8 mPa.s respectively. This is somewhat better in terms of (lignin-cellulose) ozone selectivity than the pulp obtained in the first series of tests where 2.16% of $O_3$ was charged in one stage, and resulted in a kappa no. and viscosity of respectively 13.9 and 27.9 mPa.s.

Finally, a third ozone bleaching stage with a 0.54% $O_3$ charge (actual consumption 0.50%) was applied to the pulp which had been ozonated twice with a charge of 1.08% $O_3$ in each stage. The kappa no. and viscosity of the water washed pulp thus obtained were 4.6 and 20.9 mPa.s respectively. This compares to a kappa no. and viscosity of respectively 5.0 and 16.2 mPa.s for the pulp obtained in the first test series after two stages of ozone bleaching at a charge of respectively 2.16% and 2.59% $O_3$ each.

This shows that stagewise ozone bleaching with relatively small ozone charges of about 1% is better in terms of both ozone efficiency and selectivity than applying larger charges of ozone (>2.0%) in fewer stages. The experiments also show that an unbleached kraft pulp with a kappa of 31.9 can be delignified to a kappa number of 4.6 and a viscosity above 20 mPa.s when ozone is charged in three stages of 1.08%, 1.08% and 0.54%. The total ozone consumption for all three stages is 2.53% on o.d. pulp.

It is believed that all the ozone can be added in one stage if good contact between the pulp and the ozone containing gas can be maintained.

Figure 4:
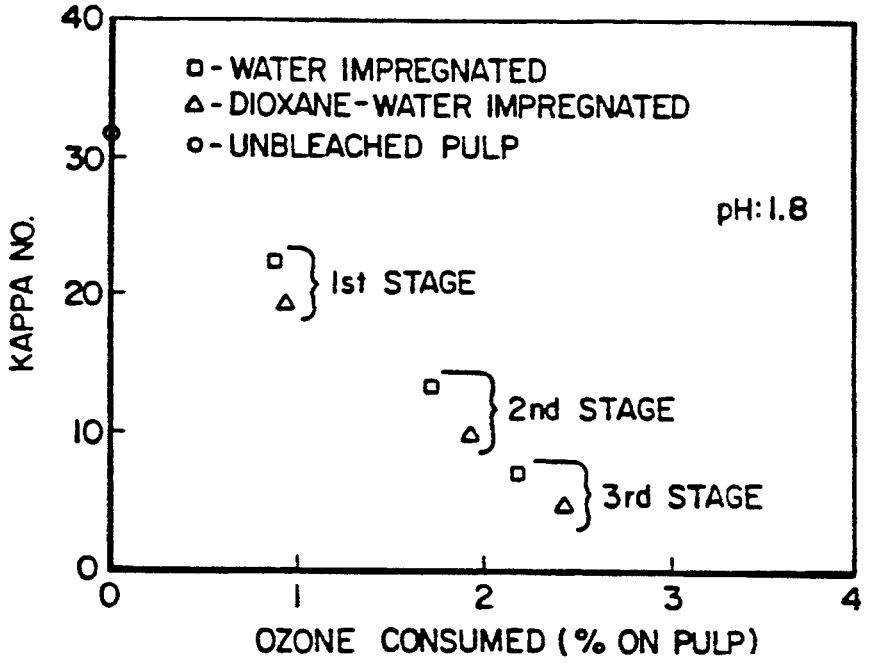
Figure 5:
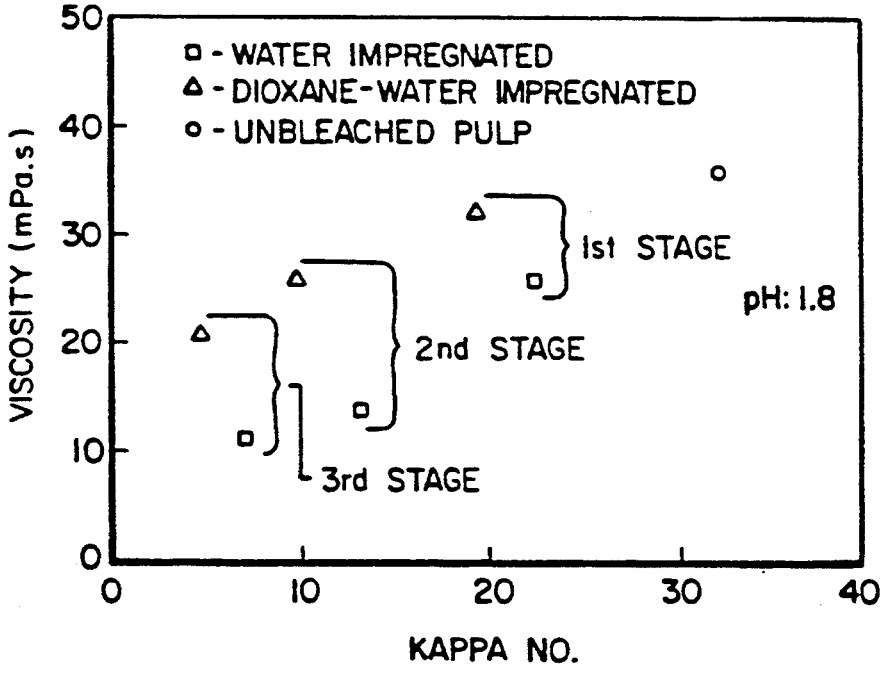

The superior ozone bleaching response of pulp impregnated with a dioxane-water solution rather than with water alone is clearly shown in FIGS. 4 and 5 which are respectively the (lignin) ozone reaction efficiency and the (lignin-cellulose) ozone selectivity when bleaching is performed in three consecutive stages with ozone charges of 1.08%, 1.08% and 0.54% respectively. In both series of experiments the pH of the impregnation liquid is 1.8, and the pulp consistency is approximately 40%. The weight percentage of dioxane in the dioxane-water impregnation liquid is 70.6%.

The results in FIGS. 4 and 5 respectively show that the presence of dioxane does not significantly change the ozone reaction efficiency but leads to a dramatic reduction in the degradation of cellulose.

Although the disclosure has shown examples of softwood kraft pulp, the invention is also believed to be applicable to hardwood kraft pulps, oxygen bleached pulps and other pulps produced by a chemical or organic solvent based pulping process, and is expected to produce equivalent improved results compared to those obtained with a conventional ozone treatment. Obviously the absolute values of the viscosity and kappa no. will reflect the type of pulp being processed. Thus the term equivalent to a Northern softwood pulp is to be interpreted as requiring suitable scaling of the absolute values normally valid for the above mentioned pulp types.

Having described the invention modifications will be evident to those skilled in the art without departing from the scope of the invention as defined in the appended claims.

We claim:

1. A totally chlorine-free method of bleaching a chemical pulp with ozone comprising uniformly impregnating said pulp with an aqueous medium containing at least 25% dioxane to provide an impregnated pulp, subjecting said impregnated pulp to the action of ozone at a pH of between 1.5 and 5 in an ozone bleaching stage substantially free of acetic acid to produce a totally chlorine-free bleached pulp having a viscosity equivalent to a viscosity of at least 21 mPa.s at a kappa no. of 5 for northern softwood pulps.

2. A method as defined in claim 1 wherein said aqueous medium contains between 50% and 90% dioxane.

3. A method as defined in claim 2 wherein said impregnated pulp is at a consistency of between 10% and 60% during said ozone bleaching stage.

4. A method as defined in claim 2 wherein said impregnated pulp is at a consistency of between 30% and 50%, and further comprising fluffing said pulp prior to introduction into said ozone bleaching stage.

5. A method as defined in claim 1 wherein said impregnated pulp is at a consistency of between 30% and 50%, and further comprising fluffing said pulp prior to introduction into said ozone bleaching stage.

* * * * *